US010012180B2

(12) United States Patent
Kimoto et al.

(10) Patent No.: US 10,012,180 B2
(45) Date of Patent: Jul. 3, 2018

(54) EVAPORATED FUEL PROCESSING DEVICE

(71) Applicant: AISAN KOGYO KABUSHIKI KAISHA, Obu-shi, Aichi-ken (JP)

(72) Inventors: Junya Kimoto, Obu (JP); Yoshikazu Miyabe, Obu (JP); Naoyuki Tagawa, Nagoya (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 50 days.

(21) Appl. No.: 15/036,278

(22) PCT Filed: Sep. 1, 2014

(86) PCT No.: PCT/JP2014/072940
§ 371 (c)(1),
(2) Date: May 12, 2016

(87) PCT Pub. No.: WO2015/075991
PCT Pub. Date: May 28, 2015

(65) Prior Publication Data

US 2016/0298577 A1 Oct. 13, 2016

(30) Foreign Application Priority Data

Nov. 25, 2013 (JP) ..... 2013-243001

(51) Int. Cl.
*F02M 33/02* (2006.01)
*F02M 25/08* (2006.01)
(Continued)

(52) U.S. Cl.
CPC ..... *F02M 25/0836* (2013.01); *F02D 41/0032* (2013.01); *F02D 41/0045* (2013.01);
(Continued)

(58) Field of Classification Search
CPC .... F02M 25/08; F02M 25/0836; F02M 33/02; F02D 41/0032; F02D 41/004; F02D 19/0621
(Continued)

(56) References Cited

U.S. PATENT DOCUMENTS

2007/0044549 A1* 3/2007 Yoshioka ..... F02M 25/0809 73/114.39
2010/0126476 A1* 5/2010 Hidano ..... F02M 25/089 123/519
(Continued)

FOREIGN PATENT DOCUMENTS

JP 2003-13808 A 1/2003
JP 2004-308483 A 11/2004
(Continued)

OTHER PUBLICATIONS

German Office Action dated Jul. 5, 2017, for German Application No. 112014005356.2 (6 p.).
(Continued)

*Primary Examiner* — John Kwon
(74) *Attorney, Agent, or Firm* — Conley Rose, P.C.

(57) ABSTRACT

An evaporated fuel processing device has a canister, a vapor passage, a purge passage, a shutoff valve, a storage device and a control device. The canister includes an adsorbent material that adsorbs evaporated fuel generated in a fuel tank. The vapor passage connects the canister and the fuel tank. The purge passage connects the canister and an intake passage of an engine. The shutoff valve is provided in the vapor passage, and adjusts flow rate of gas flowing through the vapor passage. The storage device stores in advance a reference value for the shutoff valve corresponding to internal pressure of the fuel tank. The shutoff valve is controlled based on the reference value, which is obtained from the
(Continued)

internal pressure of the fuel tank, and pressure release control is performed on the fuel tank.

8 Claims, 11 Drawing Sheets

(51) Int. Cl.
*F02D 41/00* (2006.01)
*F02D 41/14* (2006.01)
*F02M 37/10* (2006.01)

(52) U.S. Cl.
CPC ..... *F02D 41/1454* (2013.01); *F02M 25/08* (2013.01); *F02M 25/089* (2013.01); *F02M 25/0854* (2013.01); *F02M 25/0872* (2013.01); *F02M 37/10* (2013.01); *F02M 2025/0845* (2013.01)

(58) Field of Classification Search
USPC ..... 123/516–521
See application file for complete search history.

(56) References Cited

U.S. PATENT DOCUMENTS

2011/0203554 A1 8/2011 Horiba et al.
2011/0220071 A1 9/2011 Horiba et al.
2011/0296997 A1 12/2011 Sugiura
2013/0174812 A1* 7/2013 Miyata ..... F02M 25/08 123/520
2013/0174813 A1* 7/2013 Miyata ..... F02M 25/08 123/520
2015/0083089 A1* 3/2015 Pearce ..... F02M 25/0809 123/520
2016/0060093 A1* 3/2016 Criel ..... B60K 15/035 137/2
2017/0184058 A1* 6/2017 Miyata ..... F02M 25/0818

FOREIGN PATENT DOCUMENTS

JP 2005155323 A 6/2005
JP 2011144848 A 7/2011
JP 2011185227 A 9/2011
JP 2013-036392 A 2/2013

OTHER PUBLICATIONS

English Translation of German Office Action dated Jul. 5, 2017, for German Application No. 112014005356.2 (3 p.).
International Patent Application No. PCT/JP2014/072940 International Search Report dated Oct. 21, 2014 (5 pages).
Japanese Patent Application No. 2013-243001 Notification of Reasons for Refusal dated Sep. 27, 2016 (6 pages).

* cited by examiner

EVAPORATED FUEL PROCESSING DEVICE

CROSS-REFERENCE TO RELATED APPLICATIONS

The present application is a National Phase entry of, and claims priority to, PCT Applicant No. PCT/JP2014/072940, filed Sep. 1, 2014, which claims priority to Japanese Patent Application No. 2013-243001, filed Nov. 25, 2013, both of which are incorporated herein by reference in their entireties.

STATEMENT REGARDING FEDERALLY SPONSORED RESEARCH OR DEVELOPMENT

Not applicable.

BACKGROUND

The present invention relates to an evaporated fuel processing device.

An evaporated fuel processing device disclosed in JP2005-155323A has a canister, a shutoff valve, and a purge passage. The canister includes an adsorbent material for adsorbing evaporated fuel generated in a fuel tank. The shutoff valve is provided in a vapor passage connecting the canister and the fuel tank. The purge passage connects the canister and an intake passage of an engine. While the engine is driven, a predetermined purge condition is satisfied. At this time, the negative intake pressure of the engine acts on the interior of the canister through the purge passage, with the interior of the canister communicating with the atmosphere. Air flows into the canister, and the evaporated fuel adsorbed by the adsorbent material is purged. The evaporated fuel is separated from the adsorbent material, and is guided to the engine through the purge passage. The shutoff valve is opened while the interior of the canister is being purged. As a result, pressure in the fuel tank is released.

The shutoff valve is opened when it receives an ON signal from an ECU, and is closed when it receives an OFF signal from the ECU. As a result, the flow rate of the gas flowing through the shutoff valve is adjusted, and pressure in the fuel tank is released. The shutoff valve is duty-ratio-controlled by the ON signal and the OFF signal. In the duty ratio control, the shutoff valve is periodically turned ON and OFF to repeatedly undergo a totally opened state and a totally closed state. Through this control, the average flow rate per unit time of the gas flowing through the shutoff valve is adjusted. Thus, it is rather difficult to perform fine adjustment of the flow rate of the gas flowing through the shutoff valve. Further, the pressure release precision for the fuel tank is rather low.

There has been a need for an evaporated fuel processing device capable of simple and easy control for precisely releasing pressure in the fuel tank.

BRIEF SUMMARY

According to an aspect of an embodiment of the present invention, an evaporated fuel processing device has a canister, a vapor passage, a purge passage, a shutoff valve, a storage device and a control device. The canister includes an adsorbent material that adsorbs evaporated fuel generated in a fuel tank. The vapor passage connects the canister and the fuel tank. The purge passage connects the canister and an intake passage of an engine. The shutoff valve is provided in the vapor passage, and adjusts flow rate of gas flowing through the vapor passage. The storage device stores in advance a reference value for the shutoff valve corresponding to internal pressure of the fuel tank. The shutoff valve is controlled based on the reference value, which is obtained from the internal pressure of the fuel tank, and pressure release control is performed on the fuel tank. Thus, the shutoff valve is controlled based on a pre-set reference value. Thus, the pressure release control can be performed easily.

According to another aspect, the control device may be configured such that it determines whether or not the fuel tank internal pressure reduction amount within a prescribed time is smaller than a predetermined value. The control device may be configured so as to control the shutoff valve based on an addition value obtained through addition of a correction value to the reference value when the internal pressure reduction amount is smaller than the predetermined value. Thus, the degree of opening of the shutoff valve increases more when the shutoff valve is controlled based on the addition value than when the shutoff valve is controlled based on the reference value. When, for example, the amount of evaporated fuel generated in the fuel tank is large, there is a case where pressure release cannot be affected to a sufficient degree even when the shutoff valve is opened based on the reference value. In such a case, it is possible to affect pressure release on the fuel tank in a satisfactory manner.

According to another aspect, the control device may be configured such that it determines whether or not the internal pressure reduction amount of the fuel tank within the prescribed time is not smaller than (i.e., greater than or equal to) the predetermined value in the state in which the shutoff valve is being controlled based on the addition value. The control device may be configured so as to control the shutoff valve based on the reference value in a case where the internal pressure reduction amount is not less than (i.e., greater than or equal to) the predetermined value.

According to another aspect, the control device may be configured so as to obtain the internal pressure reduction amount by detecting the internal pressure of the fuel tank every predetermined period of time to compute pressure difference between the previous detection pressure and the detection pressure obtained this time. The control device may be configured so as to control the shutoff valve based on the reference value in a case where the pressure difference is not less than (i.e., greater than or equal to) a predetermined value. The control device may be configured so as to control the shutoff valve based on the addition value in a case where the pressure difference is less than the predetermined value. Thus, pressure in the fuel tank can be released in a satisfactory manner in accordance with the condition within the fuel tank.

According to another aspect, the reference value for the shutoff valve may be set in the storage device such that flow rate of gas flowing through the vapor passage does not exceed flow rate of gas flowing through the purge passage. Thus, the evaporated fuel flowing into the canister from the fuel tank through the vapor passage is not accumulated in the canister. The evaporated fuel in the canister is guided to the intake passage of the engine through the purge passage.

According to another aspect, the control device may be configured so as to determine whether or not the amount of fuel with respect to the amount of air supplied to the engine per unit time is not less than (i.e., greater than or equal to) a predetermined value. The control device may be configured such that, when the amount of fuel is not less than (i.e., greater than or equal to) the predetermined value, it obtains a subtraction value by subtracting a subtraction correction value from the reference value. The control device may be configured so as to control the shutoff valve based on the subtraction value. Thus, when the air-fuel ratio in the engine is fuel-rich, the degree of opening of the shutoff valve is reduced. The amount of evaporated fuel guided to the intake passage of the engine from the fuel tank through the canister is reduced. As a result, the air-fuel ratio in the engine is restored to normal.

According to another aspect, the control device may be configured so as to control the shutoff valve based on the reference value when the amount of fuel is less than a predetermined value in a state in which the shutoff valve is being controlled based on the subtraction value. Thus, the shutoff valve is controlled based on the reference value again when the air-fuel ratio in the engine is restored to a proper value.

According to another aspect, the control device may be configured so as determine whether or not amount of fuel with respect to amount of air supplied to the engine per unit time is not less than (i.e., greater than or equal to) a predetermined value. The control device may be configured so as to obtain a subtraction value through subtraction of a subtraction correction value from the addition value when the amount of fuel is not less than (i.e., greater than or equal to) the predetermined value. The control device may be configured so as to control the shutoff valve based on the subtraction value. Thus, the degree of opening of the shutoff valve is reduced when the air-fuel ratio in the engine is fuel-rich. The amount of evaporated fuel guided to the intake passage of the engine from the fuel tank through the canister is reduced. As a result, the air-fuel ratio in the engine is restored to normal.

According to another aspect, the control device may be configured so as to control the shutoff valve based on the addition value when the amount of fuel is less than the predetermined value in the state in which the shutoff valve is being controlled based on the subtraction value. Thus, the shutoff valve is controlled based on the addition value again when the air-fuel ratio of the engine is restored to normal.

According to another aspect, the shutoff valve may have a valve seat, and a movable valve configured to move in an axial direction with respect to the valve seat. The reference value for the shutoff valve may be a reference stroke amount, which is a movement amount of the movable valve. Thus, it is possible to perform fine adjustment on flow rate of gas flowing through the vapor passage by using the stroke amount of the movable valve. As a result, pressure in the fuel tank can be released accurately.

According to another aspect, the shutoff valve may have a feed screw mechanism, and an electric motor configured to operate the feed screw mechanism to move the movable valve. According to another aspect, the movable valve may have a valve guide, a valve body, and a biasing member. The valve guide is formed so as to be capable of contacting the valve seat. The valve body is connected to the valve guide so as to be capable of relative movement by a fixed dimension in the axial direction. As a result, the valve body is configured to contact with and to move away from the valve seat. The biasing member biases the valve body toward the valve seat.

DETAILED DESCRIPTION

Figure 1:
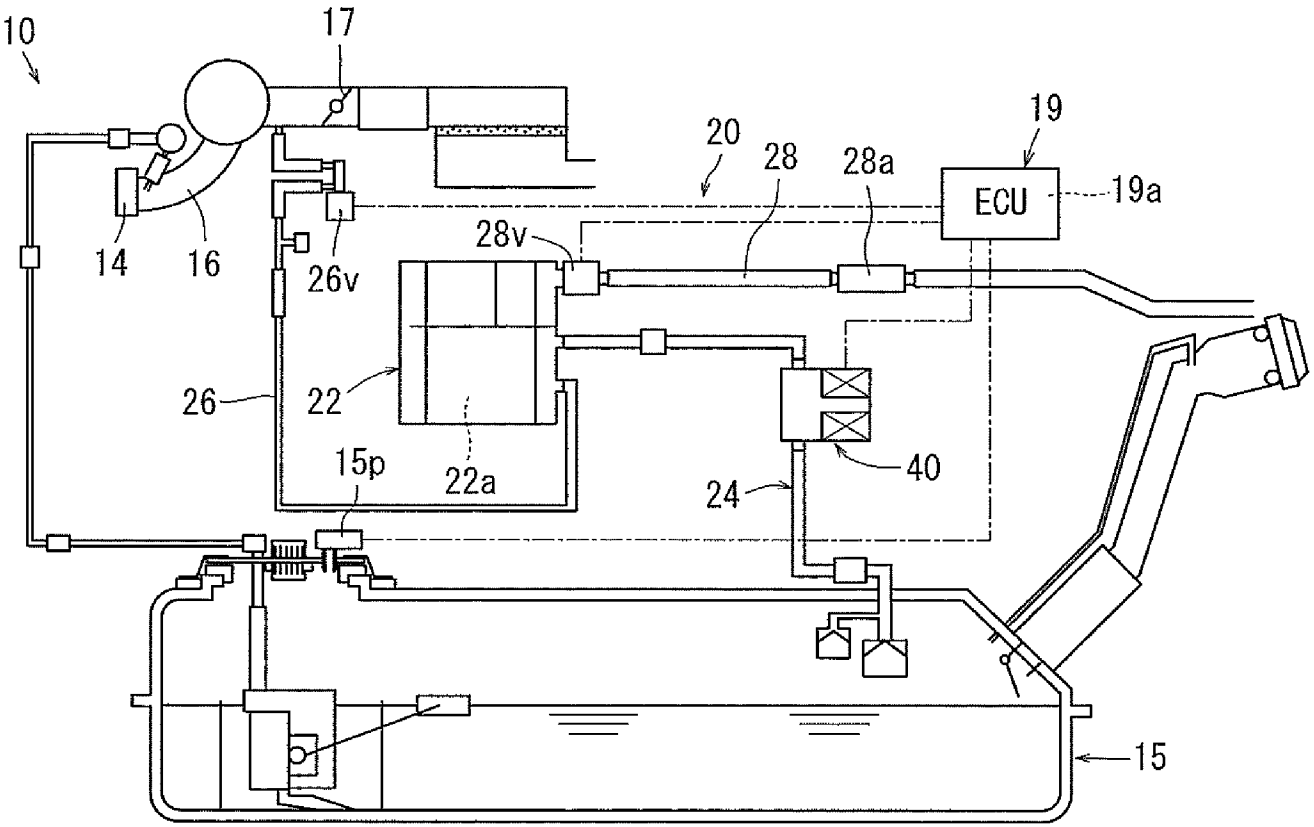
FIG. 1 is a constructive view of an evaporated fuel processing device.

An embodiment of the present invention will be described with reference to the drawings. As shown in FIG. 1, an evaporated fuel processing device 20 is provided in a vehicle engine system 10. The evaporated fuel processing device 20 is a device for preventing evaporated fuel generated in a vehicle fuel tank 15 from leaking to the outside.

As shown in FIG. 1, the evaporated fuel processing device 20 has a canister 22, a vapor passage 24, a purge passage 26, and an atmosphere passage 28. The canister 22 contains activated carbon (not shown) as an adsorbent material 22*a*. The adsorbent material 22*a* adsorbs the evaporated fuel in the fuel tank 15. One end (the upstream side end) of the vapor passage 24 communicates with a gas space in the fuel tank 15. The other end (the downstream side end) of the vapor passage 24 communicates with the interior of the canister 22. A shutoff valve 40 that allows and interrupts communication through the vapor passage 24 is provided at some midpoint of the vapor passage 24.

One end (the upstream side end) of the purge passage 26 communicates with the interior of the canister 22. The other end (the downstream side end) of the purge passage 26 communicates with a portion of an intake passage 16 of an engine 14 on the downstream side of a throttle valve 17. A purge valve 26*v* that allows and interrupts communication through the purge passage 26 is provided at some midpoint of the purge passage 26. The canister 22 communicates with the atmosphere passage 28 through an OBD component 28*v* for failure detection. An air filter 28*a* is provided at some midpoint of the atmosphere passage 28. The other end of the atmosphere passage 28 is open to the atmosphere.

The shutoff valve 40, the purge valve 26*v*, and the OBD component 28*v* are controlled based on signals from an ECU (electric control unit) 19. A signal, for example, from a tank internal pressure sensor 15*p* for detecting the pressure in the fuel tank 15 is input to the ECU 19.

While the vehicle is parked, the shutoff valve 40 is maintained in the closed state. Thus, no evaporated fuel in the fuel tank 15 flows into the canister 22. The purge valve 26*v* is maintained in the closed state. Thus, the purge passage 26 is cut off. The atmosphere passage 28 is maintained in the communicating state. When, while the vehicle is parked, an ignition switch of the vehicle is turned on, learning control in which the opening start position for the shutoff valve 40 is learned is conducted.

When, while the vehicle is traveling, a predetermined purge condition is satisfied, the ECU 19 executes purge control. In the purge control, the evaporated fuel adsorbed by the canister 22 is purged. In the purge control, the canister 22 is maintained to communicate with the atmosphere through the atmosphere passage 28. The purge valve 26*v* is controlled to open or close. When the purge valve 26*v* is opened, the negative intake pressure in the engine 14 acts on the interior of the canister 22 through the purge passage 26. As a result, air flows into the canister 22 through the atmosphere passage 28.

The ECU 19 opens the shutoff valve 40, and executes pressure release control. In the pressure release control, pressure in the fuel tank 15 is released. The gas in the fuel tank 15 flows into the canister 22 through the vapor passage 24. The adsorbent material 22*a* is purged by the air, etc. flowing into the canister 22. The evaporated fuel is separated from the adsorbent material 22*a*, and is guided to the intake passage 16 of the engine 14 together with the air. The evaporated fuel is burnt within the engine 14.

Figure 2:
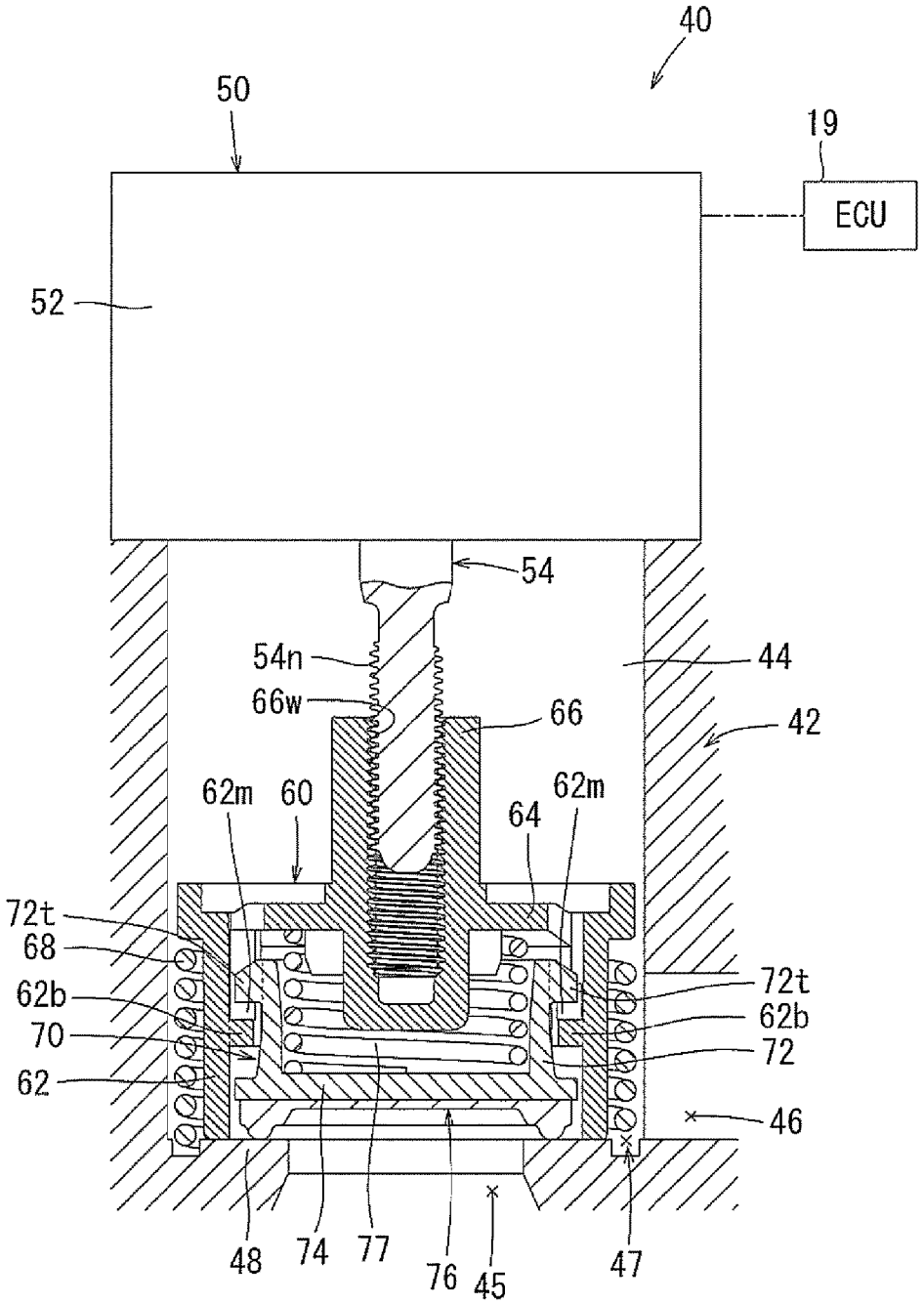
FIG. 2 is a vertical cross-sectional view of a shutoff valve of the evaporated fuel processing device in an initialization state.

The shutoff valve 40 opens and closes the vapor passage 24 to adjust the flow rate of the gas flowing through the vapor passage 24. As shown in FIG. 2, the shutoff valve 40 includes a valve casing 42, a stepping motor 50, a valve guide 60, and a valve body 70. The valve casing 42 has a fluid passage 47 establishing communication in the order: an inflow path 45, a valve chamber 44, and an outflow path 46. Below the valve chamber 44, a valve seat 48 is formed concentrically. The valve seat 48 constitutes a port edge of an upper end opening of the inflow path 45.

The stepping motor (electric motor) 50 is installed on top of the valve casing 42. The stepping motor 50 has a motor main body 52 and an output shaft 54. The output shaft 54 protrudes from the lower surface of the motor main body 52, and can rotate in the normal and reverse directions. The output shaft 54 is concentrically arranged inside the valve chamber 44. A male screw portion 54*n* is formed on the outer peripheral surface of the output shaft 54.

The valve guide 60 has a cylinder shape with a ceiling, and has a tubular wall 62 and an upper wall 64. The tubular wall 62 has a cylindrical shape, and the upper wall 64 closes the upper opening of the tubular wall 62. The valve casing 42 is provided with a whirl stop mechanism (not shown). The whirl stop mechanism allows the valve guide 60 to move in the axial direction (vertical direction) while preventing the valve guide 60 from rotating around the axis with respect to the valve casing 42. A tubular shaft 66 is formed concentrically at the central portion of the upper wall 64.

A female screw portion 66*w* is formed on the inner peripheral surface of the tubular shaft 66. The male screw portion 54*n* of the output shaft 54 is threadedly engaged with the female screw portion 66*w*. The male screw portion 54*n* and the female screw portion 66*w* form a feed screw mechanism. The valve guide 60 moves in the vertical direction (axial direction) based on the normal or reverse rotation of the output shaft 54. An auxiliary spring 68 that biases the valve guide 60 upwards is installed around the valve guide 60.

The valve body (movable valve) 70 has a bottomed cylinder shape, and has a tubular wall 72 and a lower wall 74. The tubular wall 72 has a cylindrical tube shape, and the lower wall 74 closes the lower opening of the tubular wall 72. A seal member 76 is attached to the lower surface of the lower wall 74. The seal member 76 is formed of an elastic material, e.g., a disc-shaped rubber member. The valve body 70 is arranged concentrically within the valve guide 60. The valve body 70 is arranged within the valve guide 60 such that the seal member 76 may contact with the upper surface of the valve seat 48. The tubular wall 72 has a plurality of connection protrusions 72*t*. The connection protrusions 72*t* are arranged circumferentially on the outer peripheral surface at the upper end of the tubular wall 72. The inner peripheral surface of the tubular wall 62 is formed with connection recesses 62*m* that have a vertical-groove shape.

The connection protrusions 72*t* are mounted to the valve guide 60 so as to be vertically movable within a fixed dimension by virtue of the connection recesses 62*m*. The valve guide 60 ascends, and the bottom walls 62*b* of the connection recesses 62*m* abut the connection protrusions 72*t* from below. As a result, the valve guide 60 and the valve body 70 move integrally upwards (in the opening direction). A valve spring 77 is concentrically installed between the upper wall 64 and the lower wall 74. The valve spring (biasing member) 77 biases the valve body 70 constantly downwards with respect to the valve guide 60, that is, in the closing direction.

A signal is input to the shutoff valve 40 from the ECU 19. Based on the signal, the stepping motor 50 is rotated by a predetermined number of steps in the opening direction or the closing direction. Due to the threaded engagement of the male screw portion 54*n* and the female screw portion 66*w*, the valve guide 60 moves vertically by a predetermined stroke amount. The shutoff valve 40 is totally open when the number of steps is, for example, approximately 200. The stroke amount is set, for example, to approximately 5 mm.

As shown in FIG. 2, in the initialization state, the valve guide 60 of the shutoff valve 40 is maintained at the lower limit position. The lower end surface of the tubular wall 62 abuts the upper surface of the valve seat 48. The connection protrusions 72*t* are situated above the bottom wall 62*b*. The valve spring 77 presses the seal member 76 against the upper surface of the valve seat 48 by its spring force. As a result, the shutoff valve 40 is maintained in the totally closed state. At this time, the number of steps of the stepping motor 50 is 0. The axial (vertical) movement amount of the valve guide 60, that is, the stroke amount thereof in the opening direction, is 0 mm.

While the vehicle is, for example, parked, the shutoff valve 40 is opened from the initialization state. For example, the stepping motor 50 rotates by four steps from zeroth step. The valve guide 60 moves upwards by approximately 0.1 mm (=4 steps×(5 mm÷200 steps)). As a result, no excessive force is easily applied between the valve guide 60 and the valve seat 48 due to a change in environmental factors such as temperature. In this state, the seal member 76 is pressed against the upper surface of the valve seat 48 by the spring force of the valve spring 77.

Figure 3:
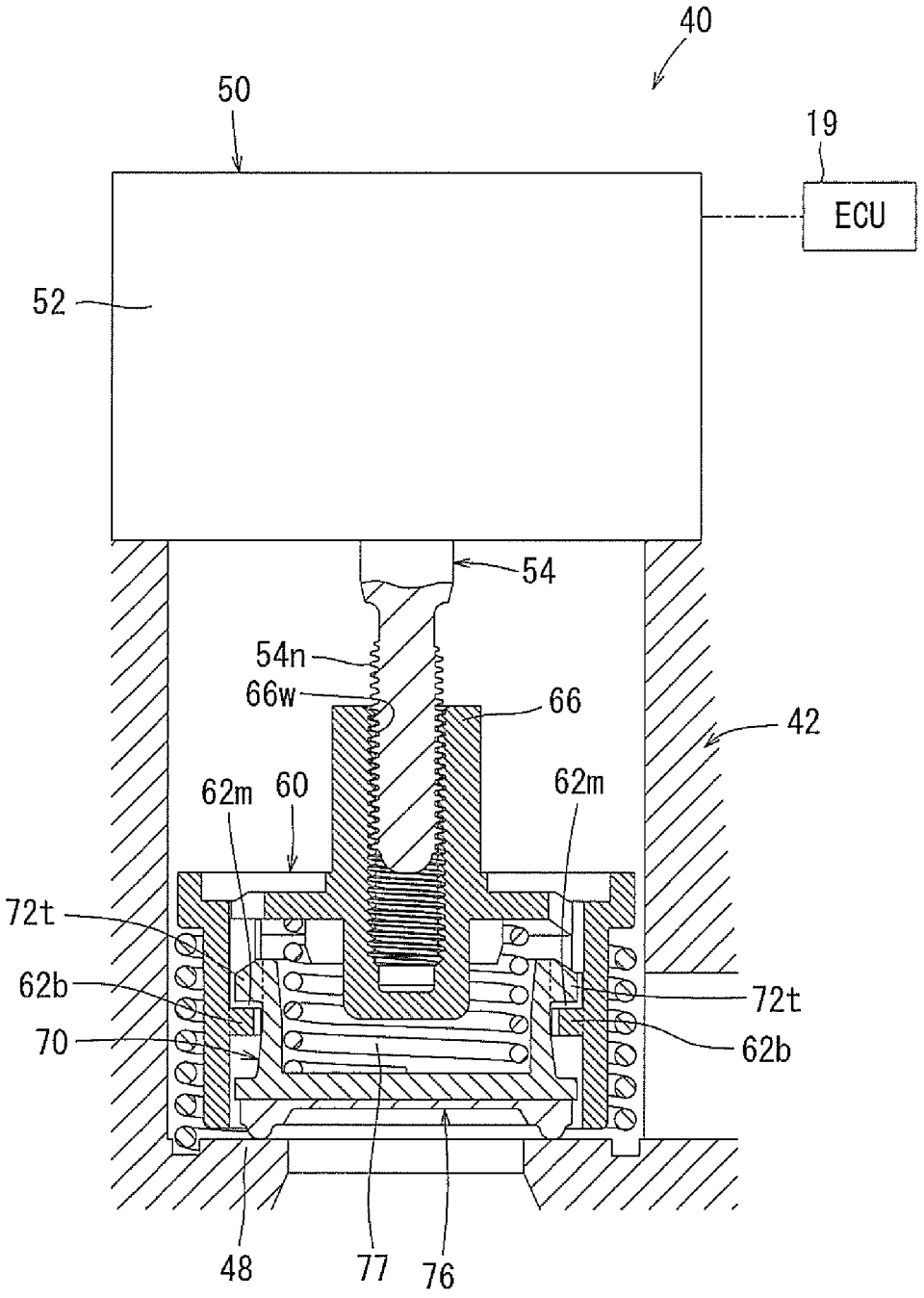
FIG. 3 is a vertical cross-sectional view of the shutoff valve in a closed state.
Figure 4:
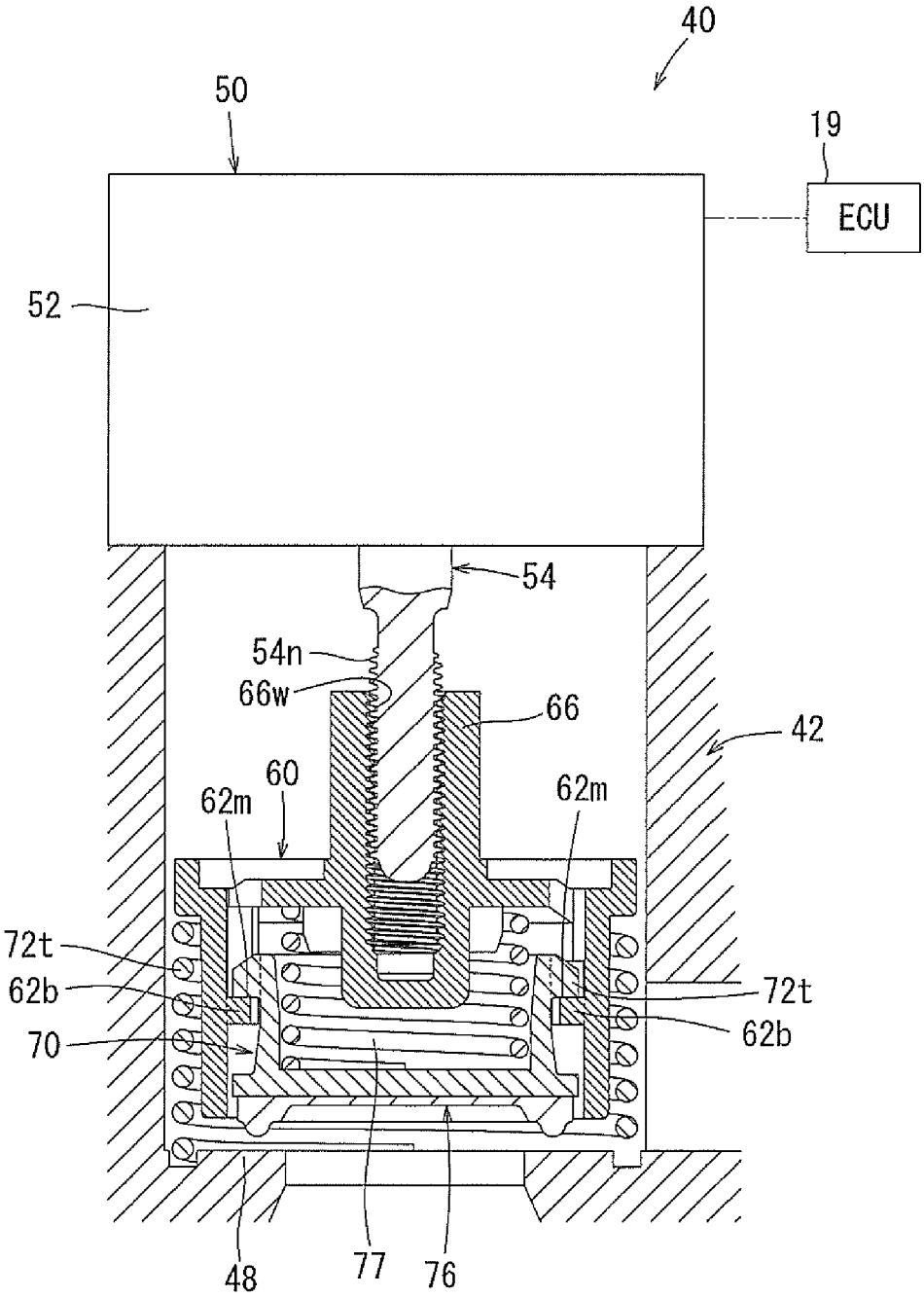
FIG. 4 is a vertical cross-sectional view of the shutoff valve in an opened state.

The stepping motor 50 further rotates in the opening direction from the position to which the stepping motor 50 has been rotated by 4 steps. The valve guide 60 moves upwards. As shown in FIG. 3, the bottom wall 62*b* abuts the connection protrusions 72*t* from below. The valve guide 60 moves further upwards. As shown in FIG. 4, the valve body 70 moves upwards together with the valve guide 60. The seal member 76 is separated from the valve seat 48. As a result, the shutoff valve 40 is opened.

The valve opening start position at which the shutoff valve 40 starts to open varies for each shutoff valve 40 depending upon the positional tolerance of the connection protrusions 72*t*, the positional tolerance of the bottom wall 62*b*, etc. Thus, it is necessary to perform learning control in which the valve opening start position is accurately learned. In the learning control, the stepping motor 50 is rotated so as to open the shutoff valve 40 to increase the number of steps. The internal pressure of the fuel tank 15 is measured while rotating the stepping motor 50. Based on the point in time when the reduction amount of the internal pressure has become a predetermined value or more, the number of steps of the valve opening start position is detected.

Figure 5:
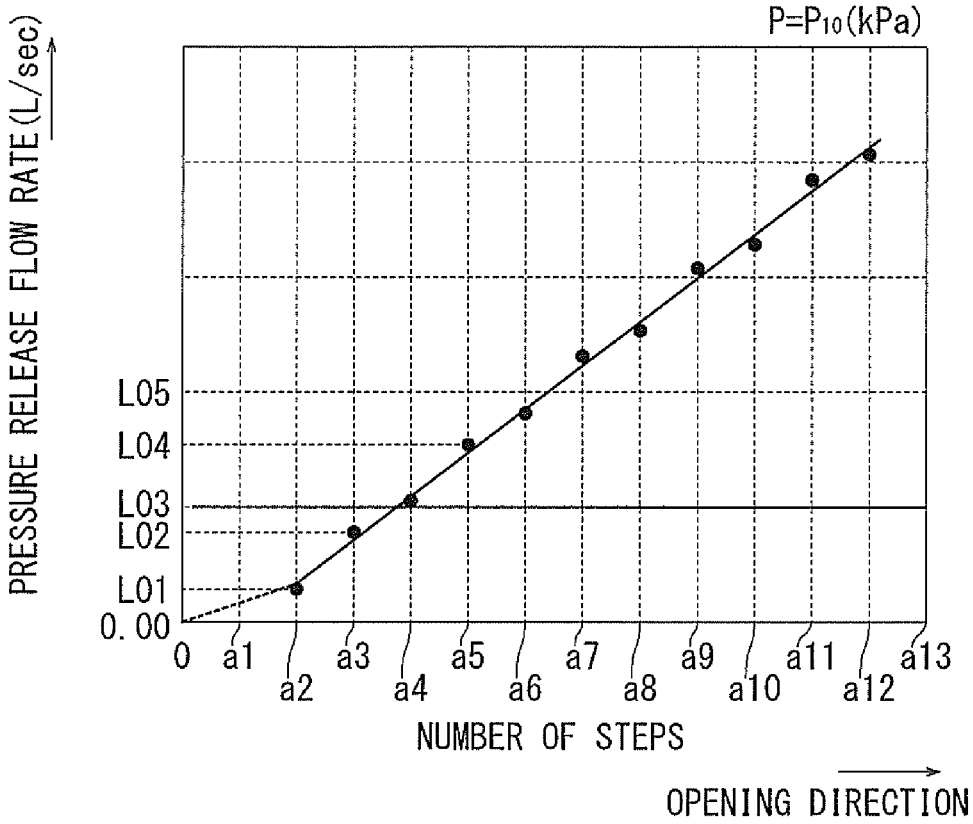
FIG. 5 is a graph illustrating flow rate characteristic of the shutoff valve when an internal pressure of a fuel tank is P10 (kPa)

FIG. 5 illustrates the flow rate characteristics of the shutoff valve 40 when the tank internal pressure P is $P_{10}$ (kPa). The tank internal pressure P is the internal pressure of the fuel tank 15, and is the pressure difference between the upstream side and the downstream side of the shutoff valve 40. The horizontal axis in FIG. 5 indicates the number of steps; at the valve opening start position, the number of steps is 0. The stepping motor 50 rotates by a4 steps in the opening direction from the valve opening start position, i.e., zeroth step. The valve body 70 moves upwards together with the valve guide 60 by approximately the following relationship: a4 steps×(5 mm÷200 steps) mm. A gas of a flow rate of approximately L03 (L/sec) flows through the shutoff valve 40. The stepping motor 50 rotates by a5 steps in the opening direction from the valve opening start position, i.e., zeroth step. The valve body 70 moves upwards together with the valve guide 60 by approximately the following relationship: a5 steps×(5 mm÷200 steps) mm. A gas of a flow rate of approximately L04 (L/sec) flows through the shutoff valve 40.

When the shutoff valve 40 is opened, the gas flows from within the fuel tank 15, and pressure in the fuel tank 15 is released. The gas, that is an air containing evaporated fuel, flows to the canister 22 through the vapor passage 24 and the shutoff valve 40. Thus, the flow rate of the gas flowing through the shutoff valve 40 is called the pressure release flow rate. The stroke amount (axial movement amount) of the valve guide 60 and the valve body 70 has a fixed relationship with the number of steps of the stepping motor 50. Thus, the stroke amount and the number of steps are of the same meaning.

Figure 6:
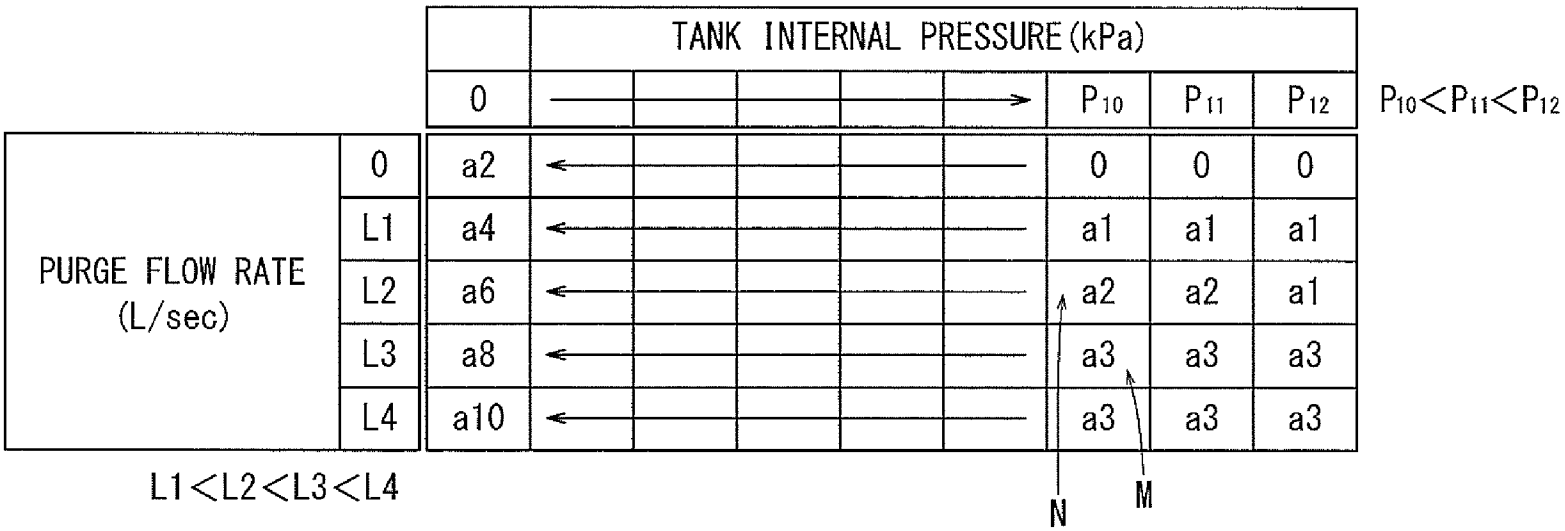
FIG. 6 is a map illustrating proper stroke amounts of the shutoff valve corresponding to purge flow rates and tank internal pressures.

The pressure release control is executed during the traveling of the vehicle simultaneously with purge control. Thus, the shutoff valve 40 is opened when the purge valve 26*v* is opened. In the pressure release control, the shutoff valve 40 is opened based on a proper stroke amount (reference stroke amount or reference value) as shown in the map of FIG. 6. The map shows a reference stroke amount (a1 through a10 step) determined by the tank internal pressure and the purge flow rate. The purge flow rate is the flow rate of the gas flowing through the purge passage 26 and the purge valve 26*v*. The reference stroke amount is set such that the pressure release flow rate does not exceed the purge flow rate.

In the map of FIG. 6, the tank internal pressure is divided at predetermined intervals from 0 to $P_{12}$ (kPa). The values of the tank internal pressure exhibit the relationship: $0< \ldots <P_{10}<P_{11}<P_{12}$. In the map of FIG. 6, the reference stroke amounts between 0 and $P_{10}$ are omitted. The purge flow rate is divided at predetermined intervals between 0 and L4 (L/sec). The values of the purge flow rate exhibit the relationship: 0<L1<L2<L3<L4. The stroke amount is set to 0 step when the shutoff valve 40 is at the valve opening start position. The reference stroke amount in the map is determined by the number of steps from the valve opening start position.

As indicated by symbol M in FIG. 6, the reference stroke amount is set to a3 step when the tank internal pressure P is $P_{10}$ (kPa) and the purge flow rate computed by the ECU 19 is L3 (L/sec). As shown in FIG. 5, when the stroke amount is a3 step, the pressure release flow rate is L02 (L/sec). L02 is less than L3 (i.e., L02<L3), thus the pressure release flow rate does not exceed the purge flow rate. As indicated by symbol N of FIG. 6, the reference stroke amount is set to a2 step when the tank internal pressure P is $P_{10}$ (kPa) and the purge flow rate computed by the ECU 19 is L2 (L/sec). As shown in FIG. 5, when the stroke amount is a2 step, the pressure release flow rate is L01 (L/sec). L01 is less than L2 (i.e., L01<L2), thus the pressure release flow rate does not exceed the purge flow rate.

Figure 7:
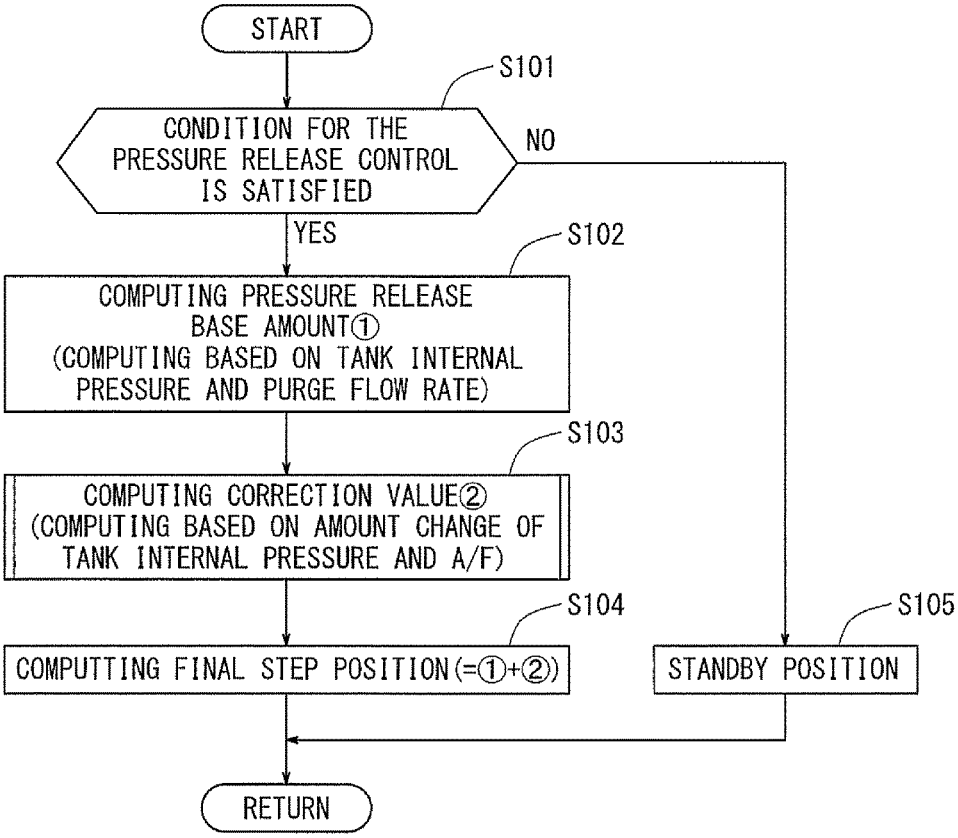
FIG. 7 is a flow chart I illustrating pressure release control of the evaporated fuel proceeding device.
Figure 8:
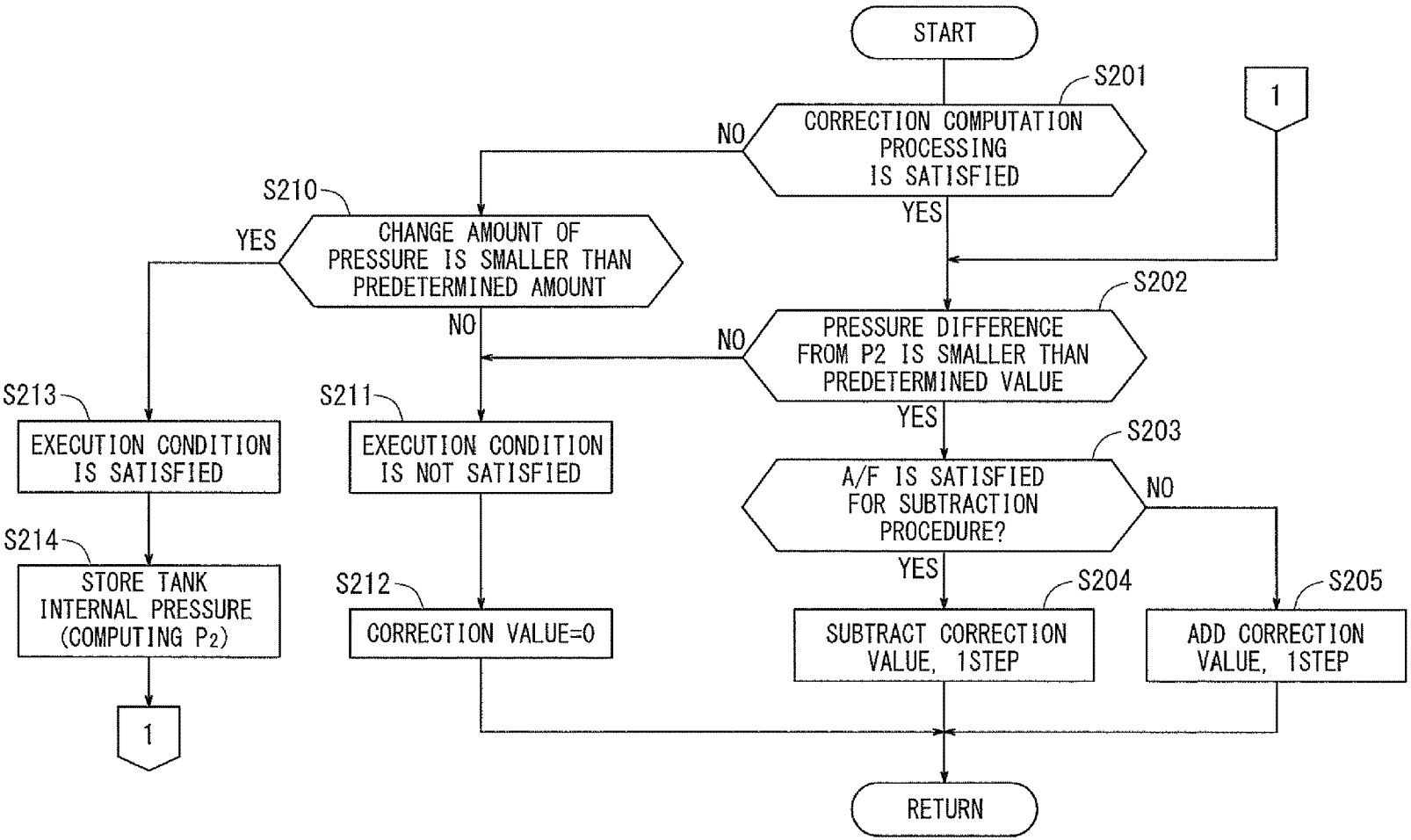
FIG. 8 is a flow chart II illustrating pressure release control of the evaporated fuel proceeding device.

The processing shown in the flowcharts of FIGS. 7 and 8 is repeatedly executed for each predetermined period of time based on a program stored in a storage device 19*a* of the ECU 19. In step S101 of FIG. 7, it is determined whether or not the condition for the pressure release control is satisfied. For example, when the vehicle is traveling, and the purge valve 26*v* is open, the condition for the pressure release control is satisfied. At this time, the judgment in step S101 is YES, and the procedure advances to step S102. When the condition for the pressure release control is not satisfied, the judgment is NO, and the shutoff valve 40 is maintained in the closed state (step S105).

When the shutoff valve 40 is at a standby position, the shutoff valve 40 is in a closed state in the vicinity of the valve opening start position. More specifically, the standby position is the position at which the stepping motor 50 has been rotated by 8 steps in the closing direction from the valve opening start position, which corresponds to the learning value. Thus, the shutoff valve 40 can be opened quickly when the shutoff valve 40 receives a signal for the valve opening direction.

In step S102, the reference stroke amount is computed from the map of FIG. 6 based on the tank internal pressure P and the purge flow rate. When the tank internal pressure P is $P_{10}$ (kPa), and the purge flow rate is L3 (L/sec), the reference stroke amount obtained is a3 step (See symbol M in FIG. 6). Next, correction computation processing of the reference stroke amount is conducted (step S103). The correction computation processing is conducted based on the flowchart of FIG. 8.

In step S201 of FIG. 8, it is determined whether or not the execution condition for the correction computation processing is satisfied. In the first processing, the execution condition is not satisfied. Thus, the judgment in steps S201 and S210 is NO, and the correction value is set to zero in step S212. The procedure returns to step S104 of FIG. 7. As a result, no correction is performed, and the shutoff valve 40 is opened based on the reference stroke amount (a3 step) selected from the map of FIG. 6 (step S104).

As shown in FIG. 5, when the reference stroke amount is a3 step, the pressure release flow rate is L02 (L/sec). A gas containing evaporated fuel flows at a flow rate of L02 from the air fuel tank 15 to the canister 22 through the vapor passage 24. As a result, pressure in the fuel tank 15 is released. As shown in the map of FIG. 6, the purge flow rate is L3, and L3 is greater than L02 (i.e., L3>L02). Thus, the evaporated fuel having flowed into the canister 22 from the fuel tank 15 does not stay in the canister 22. The evaporated fuel is guided to the engine 14 through the purge passage 26 and the purge valve 26*v*. There is no fear of the evaporated fuel in the canister 22 from being leaked into the atmosphere.

Under the normal condition, the shutoff valve 40 is opened based on the reference stroke amount selected from the map of FIG. 6. As a result, pressure in the fuel tank 15 is released in a satisfactory manner. The tank internal pressure P is reduced by the pressure difference between the tank internal pressure previously detected and the tank internal pressure detected this time. The change amount of the tank internal pressure P (reduction amount) is larger than a predetermined value. Thus, the judgment in step S210 of the FIG. 8 is NO, and the execution condition is not satisfied (step S211). Under the normal condition, the processing of steps S201, S210, S211, and S212 is repeatedly executed. Thus, there is executed control in which the correction value is zero. No correction is affected, and the shutoff valve 40 is opened based on the reference stroke amount selected from the map of FIG. 6 to execute the pressure release control (map control).

Figure 9:
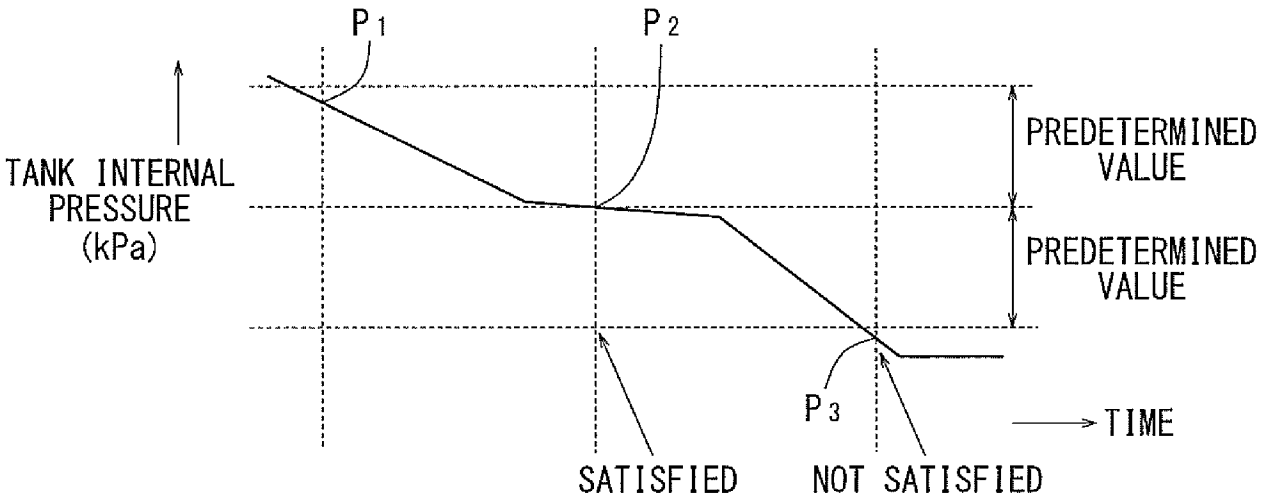
FIG. 9 is a graph illustrating time and the tank internal pressure when execution condition for computing correction value is satisfied and when the execution condition is not satisfied in the flow chart II.

When the map control is performed under an extraordinary condition, it can occur that the tank internal pressure P is not reduced as expected. Under the extraordinary condition, the amount of evaporated fuel, for example, that is generated in the fuel tank 15 is large. As shown in FIG. 9, the tank internal pressure is changed with passage of time. When the pressure difference between the tank internal pressure P1 previously detected and the tank internal pressure P2 detected this time (tank pressure difference) is smaller than the predetermined value, the judgment in step S210 is YES, and the execution condition is satisfied (step S213). The tank internal pressure P2 is stored in the storage device 19*a* (step S214). The procedure advances to step S202, and the tank internal pressure P3 detected next is compared with the tank internal pressure P2. As shown in FIG. 9, when the tank pressure difference dP is not less than a predetermined value, the judgment in step S202 is NO, and the execution condition is not satisfied (step S211). The correction value is set to zero (step S212). At this time, the map control is executed.

Figure 10:
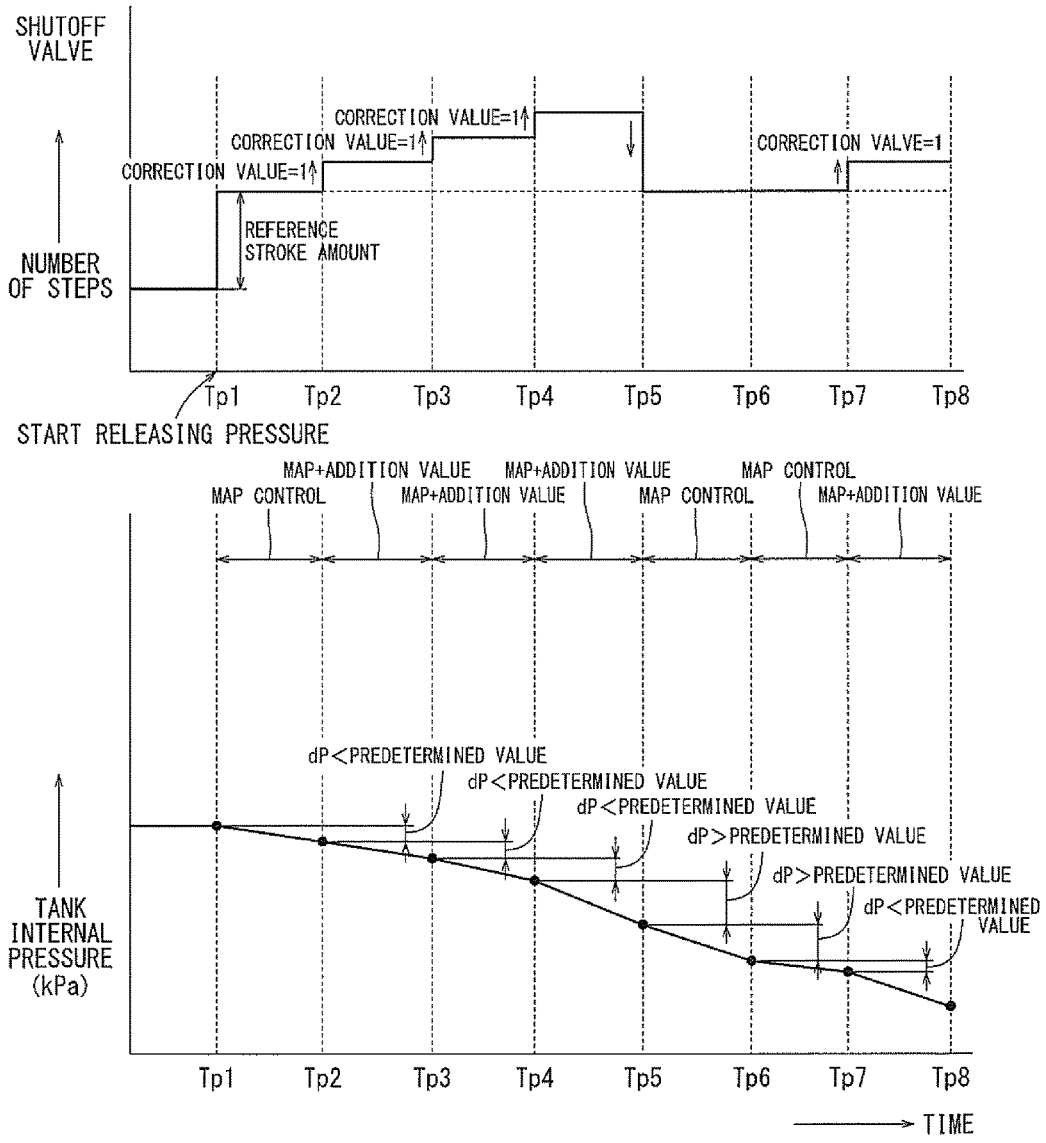
FIG. 10 is a graph illustrating relationship between stroke amount (number of steps) of the shutoff valve and the tank internal pressure (kPa)

As shown in FIG. 10, when, at point in time Tp2, the tank pressure difference dP between the tank internal pressure P1 and the tank internal pressure P2 is smaller than a predetermined value, the judgment in step S202 is YES. It is determined whether or not the air-fuel ratio of the engine 14 is fuel-rich (step S203). When the air-fuel ratio is not fuel-rich, the judgment in step S203 is NO. A correction value (1 step) is added to the reference stroke amount to thereby obtain an addition stroke value (addition value) (step S205 of FIG. 8 and step S104 of FIG. 7). The shutoff valve 40 is opened based on the addition stroke amount.

When the air-fuel ratio is not fuel-rich, the judgment in step S203 is NO. Until the tank pressure difference dP becomes larger than a predetermined value, the processing of steps S202, S203, and S205 of FIG. 8 and of step S104 of FIG. 8 are repeated. Each time the tank pressure difference dP becomes larger than the predetermined value, the correction value (1 step) is added to the addition stroke amount (See points in time Tp3 and Tp4 of FIG. 10). As shown in FIG. 10, when the tank internal pressure P is not reduced as expected, the shutoff valve 40 is opened based on the addition stroke amount. As a result, pressure in the fuel tank 15 can be effectively released (See points in time Tp1 through Tp5 of FIG. 10).

When the tank pressure difference (pressure reduction amount) has become larger than the predetermined value, the procedure returns to the map control (See point in time Tp5 of FIG. 10). When the tank pressure difference dP has become smaller than the predetermined value again as indicated by points in time Tp6 and Tp7 of FIG. 10, the correction value (1 step) is added to the reference stroke value through the processing of steps S202, S203, and S205 of FIG. 8 and that of step S104 of FIG. 7. The shutoff valve 40 is opened based on the addition stroke amount. In FIG. 10, the reference stroke amount is illustrated as a fixed value. The reference stroke value, however, is a value selected from the map of FIG. 6, and varies depending on the tank internal pressure and the purge flow rate.

Figure 11:
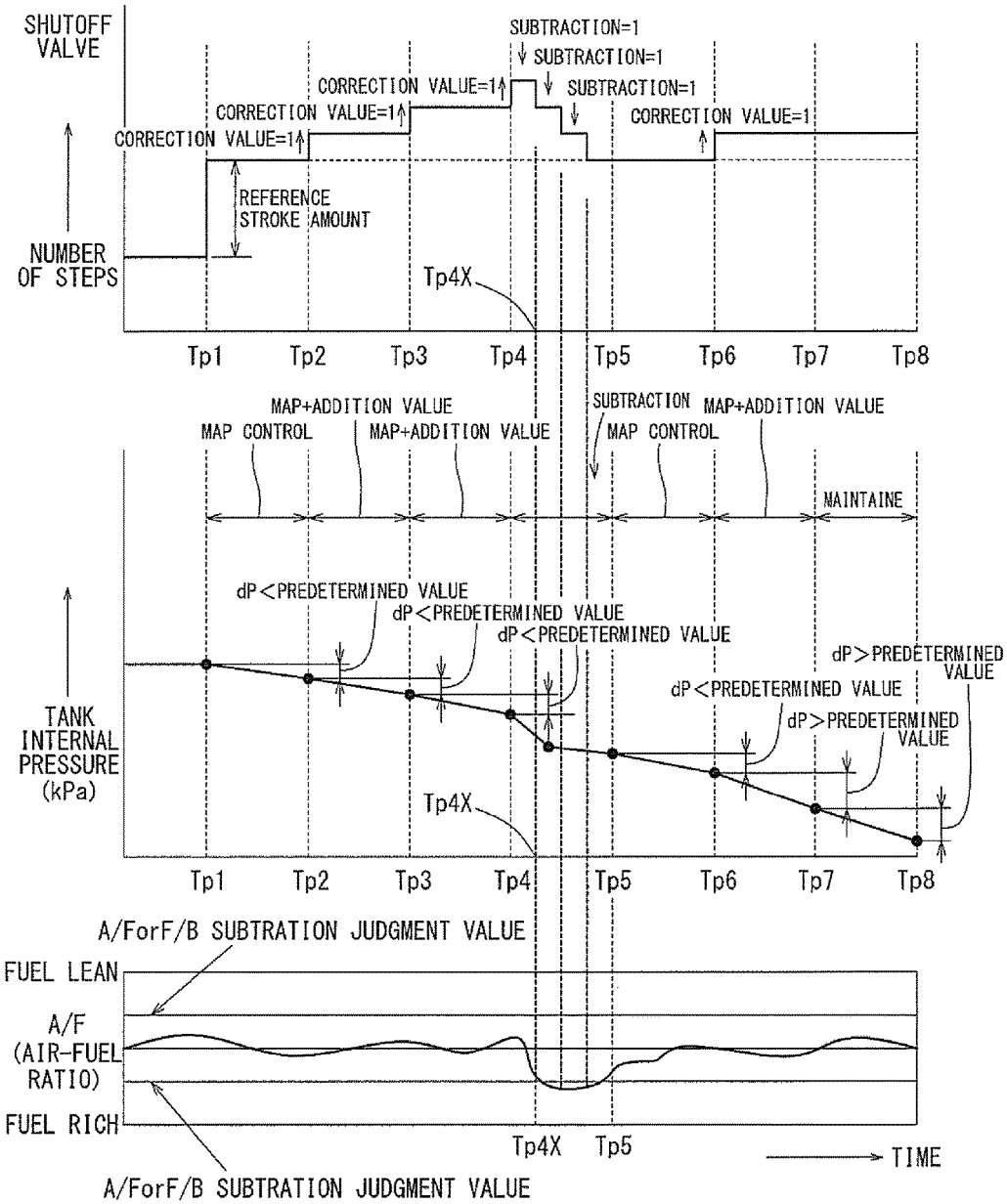
FIG. 11 is a graph illustrating relationship between stroke amount (number of steps) of the shutoff valve, the tank internal pressure (kPa) and air-fuel ratio in the engine.

As shown in FIG. 10, the addition of the correction value is continually performed, which results in an increase in the amount of evaporated fuel guided from the fuel tank 15 to the intake passage 16 of the engine 14 through the vapor passage 24, the canister 22, and the purge passage 26. As a result, the ratio of the fuel becomes richer with respect to that of the air, and the air-fuel ratio A/F is reduced (point in tie Tp4X of FIG. 11). When the ratio of the fuel becomes richer, the judgment in step S203 of FIG. 8 is YES. In step S204, a subtraction correction value (1 step) is subtracted from the addition stroke amount or the reference stroke amount, and a subtraction stroke amount (subtraction value) is obtained. Based on the subtraction stroke amount, the shutoff valve 40 is opened (step S104 of FIG. 7). The subtraction of the correction value is performed at a short cycle separately from the timing with which the tank internal pressure is judged as shown in FIG. 11. As a result, it is possible to restore the air-fuel ratio A/F to normal at an early stage. Until the air-fuel ratio A/F is restored to normal, the processing of steps S203 and S204 of FIG. 8 and that of step S105 of FIG. 7 are repeatedly executed.

The degree of opening of the shutoff valve 40 is reduced by the subtraction stroke amount. The amount of evaporated fuel guided to the intake passage 16 from the fuel tank 15 decreases. As a result, the air-fuel ratio is restored to the proper value (See point in time Tp5 of FIG. 11). The judgment time for the air-fuel ratio A/F may be shorter than the judgment time for the tank internal pressure, or may be synchronous therewith. As indicated by points in time Tp5 and Tp6 of FIG. 11, there are cases where the degree of opening of the shutoff valve 40 is reduced and where the pressure in the fuel tank 15 is not effectively released as expected. In such cases, as indicated by point in time Tp6 of FIG. 11, the correction value is added to the reference stroke amount.

In the pressure release control, the shutoff valve 40 is opened based on the reference stroke amount of the shutoff valve 40 set beforehand in accordance with the tank internal pressure P. The gas in the fuel tank 15 containing evaporated fuel is caused to escape to the canister 22 through the vapor passage 24. As a result, pressure in the fuel tank 15 is released. The shutoff valve 40 is opened based on the reference stroke amount set beforehand in accordance with the tank internal pressure P, so that the pressure release control can be executed simply and easily.

The stroke amount by which the valve body 70 is axially moved with respect to the valve seat 48 is varied. As a result, the flow rate of the gas flowing through the vapor passage 24 is adjusted. Due to this construction, fine adjustment on the flow rate of the gas flowing through the vapor passage 24 can be performed. Thus, the pressure in the fuel tank 15 can be precisely released.

In the pressure release control, it is determined whether or not the internal pressure reduction amount of the fuel tank 15 within a prescribed time (tank pressure difference) is smaller than a predetermined value. When the tank pressure difference is smaller than the predetermined value, a fixed value (1 step) is added to the previously set reference stroke amount to thereby obtain an addition stroke amount. The shutoff valve 40 is opened based on the addition stroke amount. In this case, the degree of opening of the shutoff valve 40 is larger than when the shutoff valve 40 is opened based on the reference stroke value. Thus, pressure in the fuel tank 15 is released in a satisfactory manner. For example, when a large amount of evaporated fuel is generated in the fuel tank 15, there are cases where pressure in the fuel tank 15 cannot be sufficiently released even when the shutoff valve 40 is opened based on the reference stroke amount. Also in such cases, pressure in the fuel tank 15 can be released in a satisfactory manner.

The reference stroke amount of the shutoff valve 40 is set such that the flow rate of the gas flowing through the vapor passage 24 does not exceed the flow rate of the gas flowing through the purge passage 26. Thus, the evaporated fuel having flowed into the canister 22 from the fuel tank 15 does not stay in the canister, and is guided to the intake passage 16.

There are cases where the air-fuel ratio is reduced due to the fuel supplied to the engine 14 becoming richer with respect to the air supplied thereto. In such cases, a fixed value is subtracted from the reference stroke amount of the shutoff valve or the addition stroke amount to thereby obtain a subtraction stroke amount. The shutoff valve 40 is opened based on the subtraction stroke amount. Thus, the amount of evaporated fuel guided to the intake passage 16 from the fuel tank 15 through the canister 22 is reduced. As a result, the air-fuel ratio of the engine is restored to normal.

While the embodiments of invention have been described with reference to specific configurations, it will be apparent to those skilled in the art that many alternatives, modifications and variations may be made without departing from the scope of the present invention. Accordingly, embodiments of the present invention are intended to embrace all such alternatives, modifications and variations that may fall within the spirit and scope of the appended claims. Embodiments of the present invention should not be limited to the representative configurations, but may be modified, for example, as described below.

As shown in FIG. 6, in the map, the tank internal pressure P is divided at predetermined intervals from 0 to P12. Alternatively, the tank internal pressure P may be divided more finely within the range of high frequency of use. As shown in FIG. 6, the purge flow rate is divided at predetermined intervals from 0 to L4. Alternatively, the purge flow rate may be divided more finely.

The correction value may be 1 step, or the correction value may be determined in accordance with the magnitude of the tank pressure difference. For example, when the tank pressure difference is small, the correction value may be set to a value large than 1 step. As described above, the shutoff valve 40 has the stepping motor 50 as the motor. Instead of the stepping motor 50, the shutoff valve may have a DC motor or the like.

As described above, the shutoff valve has a valve seat and a movable valve moving axially with respect to the valve seat. Alternatively, the shutoff valve may be a conventionally known valve the opening amount of which can be adjusted by an electric signal. As described above, the storage device 19*a* is provided in the ECU 19. Alternatively, the storage device may be provided in a device separate or different from the ECU. As described above, the control device is the ECU 19. Alternatively, the control device may be some other device different from the ECU provided in the vehicle, or some other device provided in something other than the vehicle.

The invention claimed is:

1. An evaporated fuel processing device comprising:

a canister including an adsorbent material that adsorbs evaporated fuel generated in a fuel tank;

a vapor passage configured to connect the canister and the fuel tank;

a purge passage configured to connect the canister and an intake passage of an engine;

a shutoff valve provided in the vapor passage, and configured to adjust flow rate of gas flowing through the vapor passage;

a storage device configured to store in advance a reference value for the shutoff valve corresponding to an internal pressure of the fuel tank; and a control device configured to perform a pressure release control by controlling the shutoff valve based on the reference value which is obtained from the internal pressure of the fuel tank, wherein the shutoff valve includes a valve seat, and a movable valve configured to move in an axial direction with respect to the valve seat, and wherein the reference value for the shutoff valve is a reference stroke amount, which is a movement amount of the movable valve;

wherein the control device is configured to determine whether or not a reduction amount in the internal pressure of the fuel tank within a prescribed time is smaller than a predetermined value;

wherein the control device is configured to control the shutoff valve based on an addition value obtained through addition of a correction value to the reference value when the reduction in the internal pressure of the fuel tank is smaller than the predetermined value;

wherein the control device is configured to determine whether or not the reduction amount of the internal pressure of the fuel tank within the prescribed time is larger than or equal to the predetermined value in a state in which the shutoff valve is being controlled based on the addition value;

wherein the control device is configured to control the shutoff valve based on the reference value in a case where the reduction amount of the internal pressure of the fuel tank is greater than or equal to the predetermined value;

wherein the control device is configured so as to obtain the reduction amount of the internal pressure of the fuel tank by detecting the internal pressure of the fuel tank every predetermined period of time to compute a pressure difference between a previous detection pressure and a current detection pressure;

wherein the control device is configured to control the shutoff valve based on the reference value in a case where the pressure difference is greater than or equal to a predetermined value; and wherein the control device is configured to control the shutoff valve based on the addition value in a case where the pressure difference is less than the redetermined value.

2. The evaporated fuel processing device of claim 1 wherein the reference value for the shutoff valve is set in the storage device such that a flow rate of gas flowing through the vapor passage does not exceed a flow rate of gas flowing through the purge passage.

3. The evaporated fuel processing device of claim 1 wherein the control device is configured to determine whether or not an amount of fuel with respect to an amount of air supplied to the engine per unit time is greater than or equal to a predetermined value;

wherein the control device is configured such that, when the amount of fuel is greater than or equal to the predetermined value, it obtains a subtraction value by subtracting a subtraction correction value from the reference value; and wherein the control device is configured to control the shutoff valve based on the subtraction value.

4. The evaporated fuel processing device of claim 3 wherein the control device is configured to control the shutoff valve based on the reference value when the amount of fuel is less than the predetermined value in a state in which the shutoff valve is being controlled based on the subtraction value.

5. The evaporated fuel processing device of claim 1 wherein the control device is configured to determine whether or not an amount of fuel with respect to an amount of air supplied to the engine per unit time is greater than or equal to a predetermined value;

wherein the control device is configured to obtain a subtraction value through subtraction of a subtraction correction value from the addition value when the amount of fuel is greater than or equal to the predetermined value; and wherein the control device is configured to control the shutoff valve based on the subtraction value.

6. The evaporated fuel processing device of claim 5 wherein the control device is configured to control the shutoff valve based on the addition value when the amount of fuel is less than the predetermined value in a state in which the shutoff valve is being controlled based on the subtraction value.

7. The evaporated fuel processing device of claim 1 wherein the shutoff valve has a feed screw mechanism, and an electric motor configured to operate the feed screw mechanism to move the movable valve.

8. The evaporated fuel processing device of claim 1 wherein the movable valve includes:

a valve guide formed so as to be capable of contacting the valve seat;

a valve body connected to the valve guide so as to be capable of relative movement by a fixed dimension in an axial direction thereby the valve body contacts with and moves away from the valve seat; and a biasing member configured to bias the valve body toward the valve seat.

* * * * *